United States Patent [19]

Schlösser

[11] Patent Number: 4,770,749

[45] Date of Patent: Sep. 13, 1988

[54] COKE OVEN DOOR

[75] Inventor: Rainer Schlösser, Essen, Fed. Rep. of Germany

[73] Assignee: Krupp Koppers GmbH, Essen, Fed. Rep. of Germany

[21] Appl. No.: 67,222

[22] Filed: Jun. 25, 1987

[30] Foreign Application Priority Data

Jul. 30, 1986 [DE] Fed. Rep. of Germany ..... 3625808

[51] Int. Cl.[4] ..... C10B 25/16

[52] U.S. Cl. ..... 202/242; 202/248; 202/269; 49/481

[58] Field of Search ..... 202/242, 248, 269; 110/173 R; 49/480, 481, 485

[56] References Cited

U.S. PATENT DOCUMENTS 3,933,598 1/1976 Pries ..... 202/248

4,028,193 6/1977 Nagayoshi ..... 202/248

*Primary Examiner*—Barry S. Richman

*Assistant Examiner*—Joye L. Woodard

*Attorney, Agent, or Firm*—Michael J. Striker

[57] ABSTRACT

The coke oven door is provided with a sealing diaphragm which has a sealing strip which comes to engagement with the frame which defines the chamber of the coke oven when the door closes, a plurality of pressure elements each including a housing and an adjustable spring to apply a force to the sealing strip to tightly seal the door in the closed position. The door has a number of radial projections that have cast bores, receiving threaded bolts extending through a common cross-piece to which the housing of the pressure elements are also secured. Counter nuts are mounted on the threaded bolts to adjustably secure the position of the cross-piece and thus the housings of the pressure elements secured thereto, and thereby adjust the force applied by the spring to the sealing strip.

2 Claims, 2 Drawing Sheets

COKE OVEN DOOR

BACKGROUND ON THE INVENTION

The present invention relates to a coke oven door of the type provided with a sealing diaphragm.

Coke oven doors of the type under discussion have sealing diaphrams, the sealing lips of which are in contact with the frame of the oven chamber by means of pressure elements formed by adjustable springs acting on the sealing lips.

With known doors of the coke ovens, housing parts for the pressure elements are either directly cast to the door body or screwed to the body of the door. In both cases, these housing parts are non-changeable in their position relative to the body of the door. In order to adjust a force acting on the sealing strip, threaded plugs have been required, which have been inserted in the end portion of the housing part, facing away from the sealing strip.

With cast or molded housing parts, bores must have been drilled at the periphery of the door body, for example, about 80 bores if the door was 6 m heigh. These bores were provided with internal threads to receive the threaded plugs. The latter also had to be treated to make external threads thereon.

With the housing parts, which are to be screwed on the door body, it has been necessary to prepare the external surface of the door body and to form thereon threaded holes for securing separately made housing parts for the pressure elements to the body of the door of the coke oven.

Both known solutions, however, have involved considerable expenses in the making of the function-ready arrangement of the pressure elements.

SUMMARY OF THE INVENTION

It is an object of the present invention to provide an improved coke oven door.

It is another object if the invention to provide a coke oven door in which expensive threaded plugs as well as the special treatment of the door body for applying thereto of the pressure elements would be omitted.

These and other objects of the invention are attained by a coke oven door comprising a body; a sealing diaphragm having a sealing strip; pressure elements, said sealing strip coming in contact with an oven chamber frame, by means of said pressure elements when the door is closed, said pressure elements being secured to said body and each including a housing, an adjustable spring, and a pressure member loaded by said spring and acting on said sealing strip, said body having a periphery and provided at said periphery with a plurality of projections cast therewith, said projections each having a cast through bore; a plurality of threaded bolts each received in said through bore and secured therein; and a cross-piece which is penetrated by said bolts and thus connects said bolts to each other, said housing of each pressure element being secured to said cross-piece.

According to a further feature of the invention the oven door may include counter nuts mouhted in said threaded bolts for adjusting and securing a position of said cross-piece with the housings of said pressure elements to thereby provide a desired force acting on said sealing strip by means of said springs arranged in said housings.

The cross-piece may extend parallel to said sealing strip.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
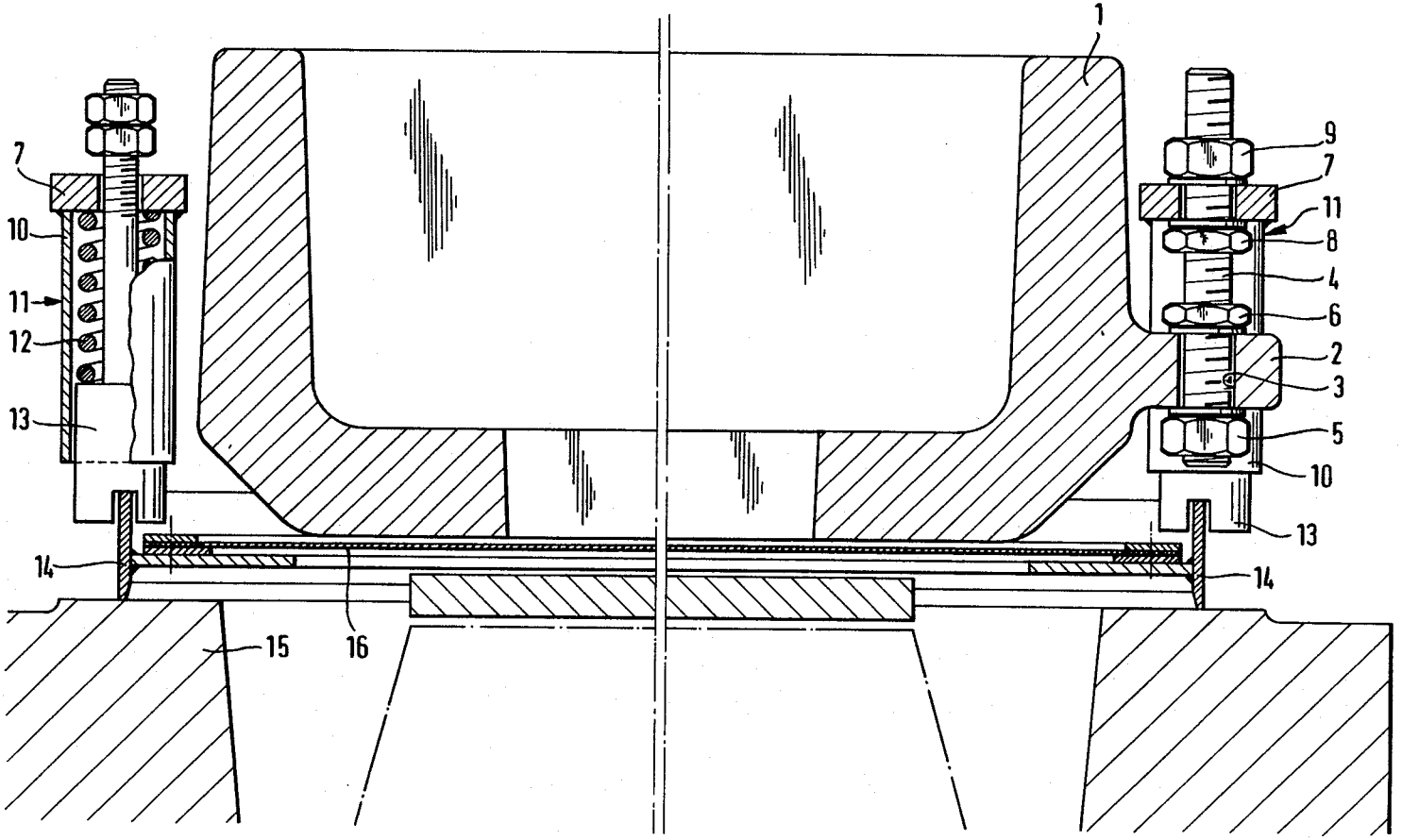
FIG. 1 is a sectional view through the coke oven door according to the invention.

Referring now to the drawings in detail, it will be seen that reference numeral 1 designates a cast door body which has at its periphery a plurality of projections 2 molded thereon. These projections 2 each have a roughly cast through bore 3 in which a threaded bolt 4 is inserted and secured there by means of nuts 5 and 6. The bolt 4 further penetrates a cross-piece 7 the position of which is secured by counter nuts 8 and 9. Reference numeral 16 denotes a sealing diaphragm.

Figure 2:
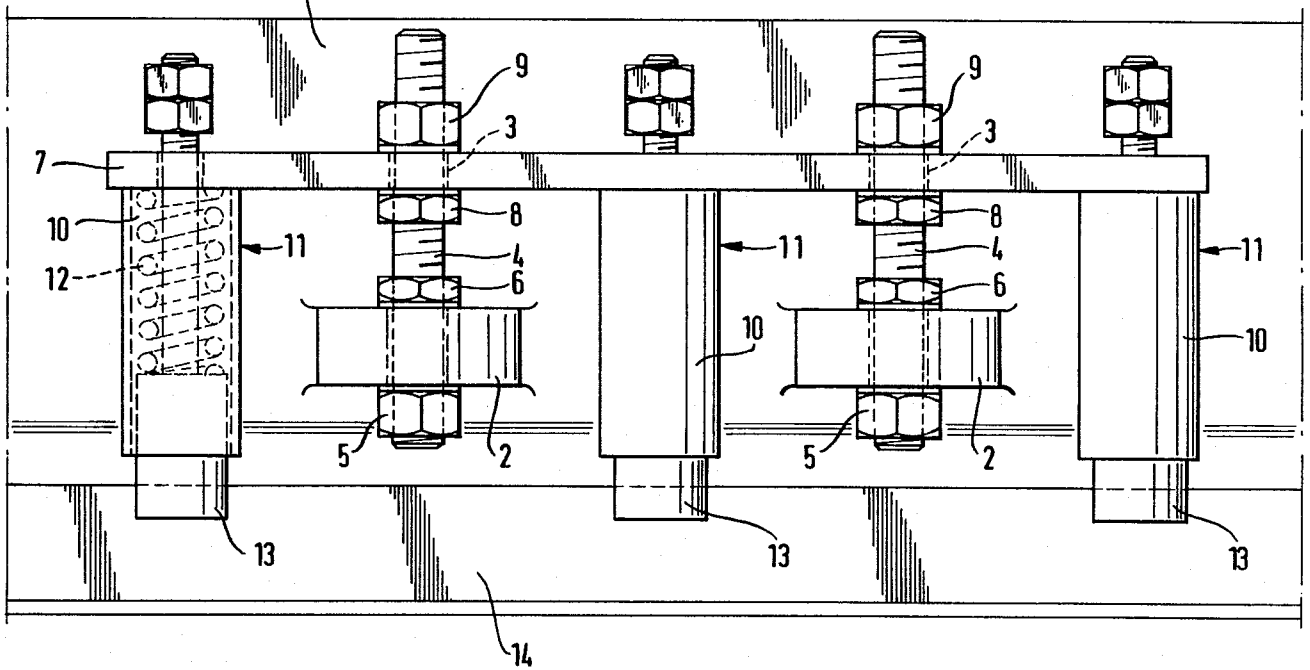
FIG. 2 is a partial side view of the door of the coke oven.

As can be seen from FIG. 2, according to a preferred embodiment, cross-piece 7 is held by two neighboring bolts 4. In this case three housings 10 of pressure elements 11 are rigidly connected, for example by welding to the cross-piece 7. A spring 12 is inserted in each housing 10. This spring 12 acts via a pressure member 13 on a sealing strip 14 of the sealing diaphragm 16 while the latter tightly comes in contact with a chamber frame 15. The sealing strip 14 itself is connected with the diaphragm 16 in the known fashion, which diaphragm in turn is connected in a non-shown manner to the door body, for example in a dot-like manner.

By the adjustment of the cross-piece 7 at the threaded bolts 4, a desired force can be adjusted, which is exerted on the sealing strip 14 whereupon this adjustment will be secured by counter nuts 8 and 9. Also, in operation, a new adjustment can be performed in a simple fashion.

Threaded plugs which have been required with conventional doors for coke ovens can be omitted in the arrangement of this invention whereby pressure elements are less expensive. The treatment of the door body for the connection of the pressure elements can be completely omitted because the connection take place by means of roughly cast bores 3 provided in projections 2. This results in cost reductions and substantial simplification of the manufacture of the oven doors.

The arrangment of FIG. 2, in which two threaded bolts correspond to three pressure elements is the most advantageous. This results in the reduction of connection points of the pressure elements at the door body. It is understandable that other than the aforedescribed number of the threaded bolts in connection with the pressure elements could be provided.

It will be understood that each of the elements described above, or two or more together, may also find a useful application in other types of coke oven doors differing from the types described above.

While the invention has been illustrated and described as embodied in a coke oven door, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letter Patent is set forth in the appended claims:

1. A coke oven door comprising a body, a sealing diaphragm having a sealing strip and pressure elements, said sealing strip coming in contact with an oven chamber frame by means of said pressure elements when the door is closed, said pressure elements each including a housing, an adjustable spring, and a pressure member loaded by said spring and acting on said sealing strip, said body having a periphery and being provided at said periphery with a plurality of projections radially outwardly extending therefrom and cast therewith, said projections each having a cast through bore, a plurality of threaded bolts each received in said through bore and secured therein, a crosspiece extending normal to and penetrated by said bolts and held thereby, said housing of each pressure element being secured to said crosspiece, said spring of each pressure element being positioned in the housing of the respective pressure element to press said pressure member against said sealing strip when the door is closed, and counter nuts mounted on said threaded bolts for adjusting a position of said crosspiece and the housings of said pressure elements relative to said sealing strip and thereby adjust a force acting on said sealing strip by said spring loaded pressure member when the door is closed, said counter nuts also securing an adjusted position of said crosspiece and said housing relative to said sealing strip.

2. The coke over door as defined in claim 1, wherein said cross-piece extends parallel to said sealing strip.

* * * * *